United States Patent [19]

Martini et al.

[11] Patent Number: 4,796,879

[45] Date of Patent: Jan. 10, 1989

[54] METHOD AND APPARATUS FOR STACKING SHEETS CONVEYED CONTINUOUSLY TO A STACKING POINT

[75] Inventors: Norbert Martini, Erkrath; Peter Naudascher, Hilden, both of Fed. Rep. of Germany

[73] Assignee: Jagenberg Aktienbesellschaft, Dusseldorf, Fed. Rep. of Germany

[21] Appl. No.: 938,206

[22] Filed: Dec. 4, 1986

[30] Foreign Application Priority Data

Dec. 17, 1985 [DE] Fed. Rep. of Germany ..... 3544511
May 15, 1986 [DE] Fed. Rep. of Germany ..... 3616470

[51] Int. Cl.[4] ..... B65H 31/32; B65H 29/34

[52] U.S. Cl. ..... 271/218; 414/790.8; 414/796.1

[58] Field of Search ..... 271/207, 213, 214, 215, 271/217, 218, 219, 189; 414/50, 101, 114, 115; 221/251

[56] References Cited

U.S. PATENT DOCUMENTS

| | | | |
|---|---|---|---|
| 2,770,392 | 11/1956 | Roberts | 221/251 X |
| 3,298,683 | 1/1967 | Stroud | 271/218 |
| 4,162,649 | 7/1979 | Thornton | 271/218 X |
| 4,311,475 | 1/1982 | Imai | 271/218 X |
| 4,359,218 | 11/1982 | Karis | 271/218 X |
| 4,396,334 | 8/1983 | Byrt | 271/189 X |
| 4,436,472 | 3/1984 | Kunzmann | 271/218 X |
| 4,478,403 | 10/1984 | Byrt | 271/218 X |
| 4,508,333 | 4/1985 | Byrt | 271/218 |

FOREIGN PATENT DOCUMENTS

| | | |
|---|---|---|
| 3122451C2 | 2/1982 | Fed. Rep. of Germany . |
| 3304673 | 8/1984 | Fed. Rep. of Germany . |
| 3413597 | 10/1985 | Fed. Rep. of Germany . |

*Primary Examiner*—Joseph J. Rolla
*Assistant Examiner*—Edward S. Ammeen
*Attorney, Agent, or Firm*—Sprung Horn Kramer & Woods

[57] ABSTRACT

A method and an apparatus for stacking sheets conveyed continuously at a stacking point. With the assistance of a separating member (6, 7), which can be introduced into a natural gap between the upper side of a stack and the sheets conveyed in an overlapping manner, in the conveying direction from the rear side of the stack (4), two gaps are created one after the other, into which clamping jaws (9, 10) arranged at different heights can be inserted. By clamping the wad of sheets (13) located between the inserted clamping jaws (9, 10), with simultaneous lowering of the stack of sheets (4), a larger gap is created below the wad of sheets (10), into which an auxiliary stacking platform (11), located directly below the lower clamping jaw (9), can be introduced. Since the sheets of the wad of sheets are held by the clamping jaws (9, 10), there is no danger that sheets may slide due to the formation of a "bow wave" at the front edge of the auxiliary stacking platform (11), as it is inserted.

1 Claim, 10 Drawing Sheets

Figure 5:
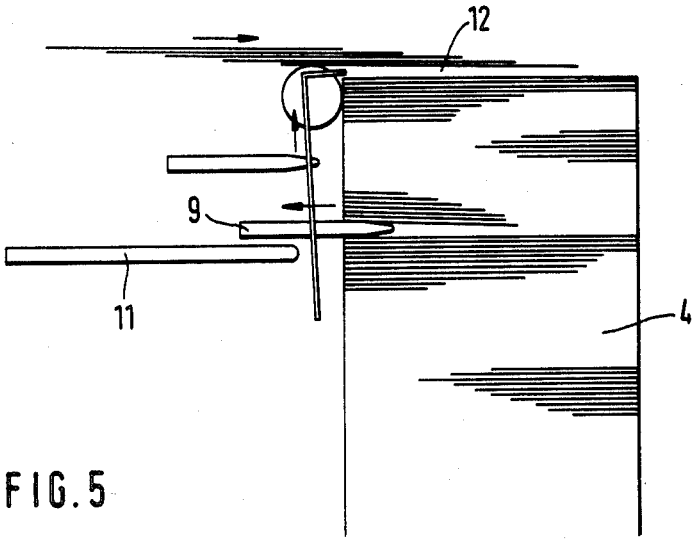

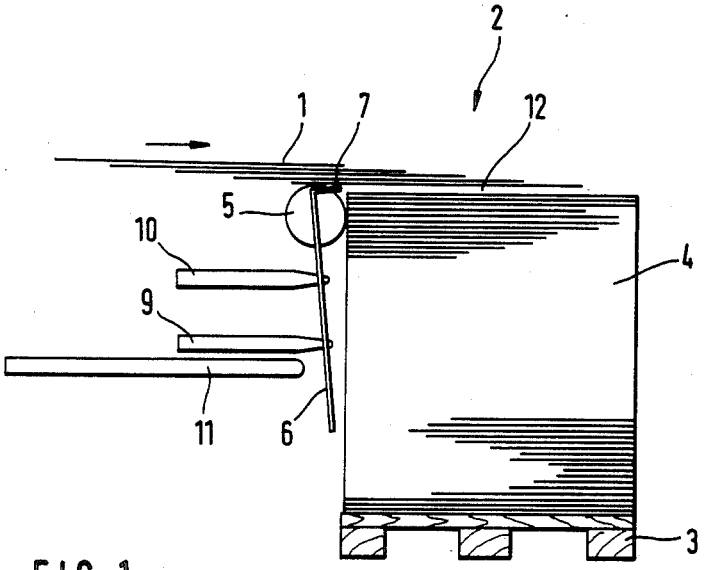
FIG. 1
FIG. 2
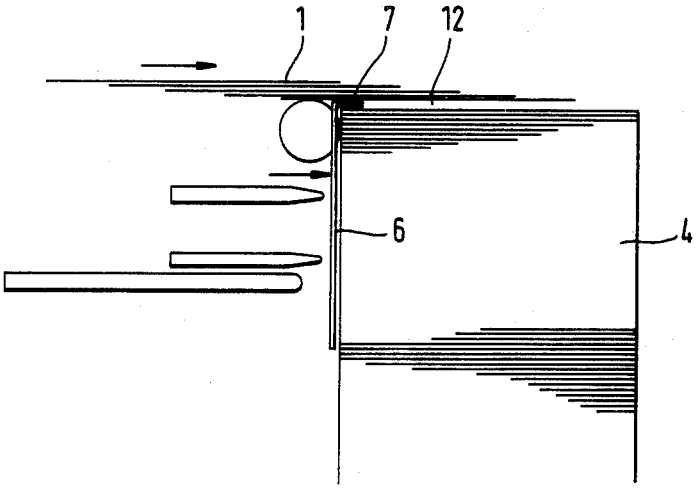

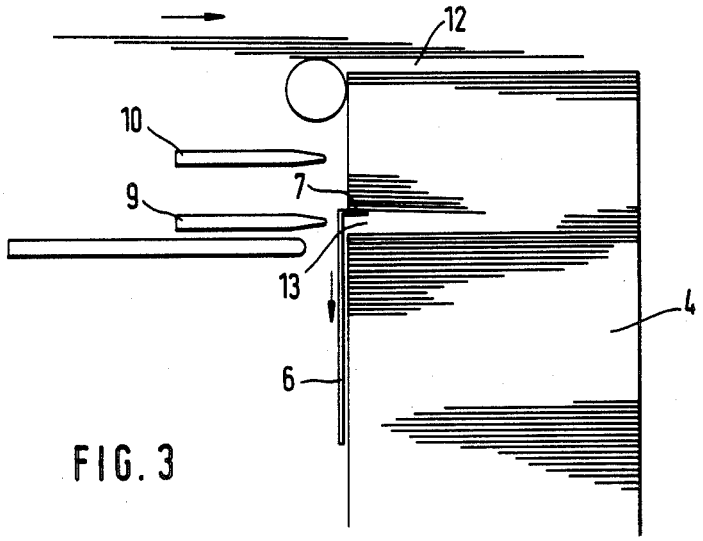
FIG. 3
FIG. 4
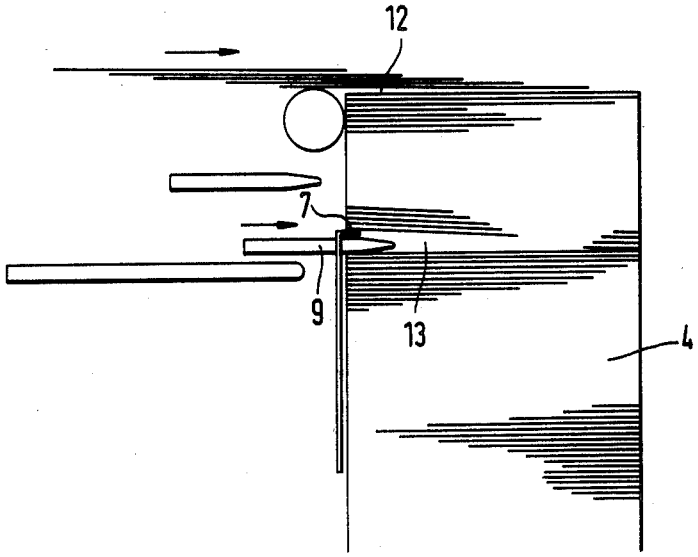

METHOD AND APPARATUS FOR STACKING SHEETS CONVEYED CONTINUOUSLY TO A STACKING POINT

The invention relates to a method for changing a stack of sheets in the case of continuous conveyance of sheets to the stacking point, using a stacking platform for the stack of sheets, which can be lowered and removed from the stacking point and is constructed in particular as a pallet, a separating member which can be inserted in the region of the upper side of the stack of sheets which is forming, from its rear side in the conveying direction and which can be lowered and an auxiliary stacking platform formed in particular from air bars which can be inserted in the conveying direction from this side in a gap formed at the insertion point of the separating member in the stack of sheets.

It is known from ( DE No. 31 22 451 C2), to stack sheets conveyed in an overlapping manner to a stacking point, on a stacking platform which can be lowered. Lowering of the stacking platform takes place to an extent such that the upper side of the stack of sheets on the stacking platform remains substantially at the level of the conveying plane of the sheets which are conveyed in an overlapping manner. When the stack of sheets on the stacking platform has reached a certain height, it is necessary to discharge the stacking platform with the stack of sheets located thereon and to stack the sheets on an empty stacking platform. In order that no sheets are wasted when the stack is changed, in order to prepare for the change of stack and during the change of stack, the sheets are laid on an auxiliary stacking platform which can likewise be lowered and is constructed for example as a screen, which platform can be introduced in the conveying direction of the sheets into a gap between the upper side of the stack of sheets and the sheets conveyed in an overlapping manner. In order to facilitate the insertion, a separating member tapering to a point at the front is located in front of the stack of sheets. After the separating member is introduced into the gap, it is lowered to a lesser extent than the stacking platform, so that the gap is enlarged. The auxiliary stacking platform may then be introduced into this gap, so that the latter completely supports the sheets conveyed in the meantime. In order that the lower sheet is not under excessive load at the time of insertion, the auxiliary stacking platform may consist of air bars. However, it is also possible to provide them with belts guided on rollers, so that the relative movement between the lower sheet of the stack of sheets and the movable belts is equal to zero. Nevertheless, even in the case of an auxiliary stacking platform constructed in this way, it is not possible to prevent displacements of the individual sheets occurring as a result of the "bow wave" forming at the time of insertion in the sheets of the stack formed in the meantime, at the front edge of the auxiliary stacking platform. A further drawback of the apparatus consists in that special precautions must be taken in order to prevent disturbances in the further conveyance of the overlapping sheets, for since the stack of sheets forms on the separating device, the stacking plane rises. Therefore, guide means for the sheets must be provided, by which the conveying plane of the sheets conveyed in an overlapping manner can be raised in accordance with the growth of the stack of sheets on the separating device.

The invention relates to a method for changing a stack of sheets conveyed continuously and to an apparatus suitable therefor, in which there is no danger of slipping of the sheets when the stack is changed.

According to the method, this object is achieved due to the fact that when using a pair of clamping jaws which can be lowered, is located on the rear side of the stack of sheets in the conveying direction and with clamping jaws which can be inserted individually, after inserting the first clamping jaw in the gap formed in the stack of sheets and with continuing lowering of the stack of sheets with the separating member, a second gap which is higher than the first gap is formed in the region of the upper side of the stack of sheets, in which the second clamping jaw is inserted as lowering of the stack of sheets continues and that after removing the separating member from the second gap and after gripping of the wad of sheets located between the clamping jaws, the auxiliary stacking platform is inserted in this gap, while increasing the first gap, and then the discharge platform with the remaining stack of sheets is removed from the stacking point and the gripped wad of sheets is laid on an empty stacking platform raised up below the auxiliary stacking platform. Preferably the laying of the wad of sheets on the empty platform takes place in such a way that the auxiliary stacking platform is withdrawn while the pair of clamping jaws is still active.

The invention also relates to an apparatus for carrying out this method, which is characterized by a stacking platform for the stack of sheets to be formed, which platform can be lowered and a separating member located in the conveying direction of the sheets on the rear side of the stack of sheets to be formed, which separating member is vertically adjustable and in its upper position in the region of the upper side of the stack of sheets can be inserted in particular between the upper side of the stack of sheets and the overlapping sheets and in its lower position can be withdrawn from the stack of sheets, by a pair of clamping jaws located on the same side of the stack of sheets as the separating member, whereof both vertically adjustable clamping jaws can be inserted independently of each other in the gaps in the stacks of sheets of staggered height and which are created by the separating member and by an auxiliary stacking platform located on the same side of the stack of sheets as the separating member and the clamping jaws in the region of the lower position of the lower clamping jaw and able to be introduced between the wad of sheets gripped by the clamping jaws and the stack of sheets carried by the stacking platform.

In the invention, both during the preparation for the change of stack as well as during the change of stack, the stacking plane remains unchanged with respect to stacking on the stacking platform which can be lowered or the stack of sheets able to be lowered with the stacking platform. Thus, additional means for moving the conveying plane of the sheets conveyed in an overlapping manner may be dispensed with. Since the insertion of the separating member takes place in the conveying direction between the upper side of the stack and the sheets conveyed in an overlapping manner, the natural gap at this point is utilized, so that the danger of damage to sheets other than when inserting the separating member into the already formed stack of sheets does not exist. Since greater gaps can be provided by the separating member even without stress on the sheets, even the thicker clamping jaws can be introduced sufficiently far into the stack of sheets. After clamping of the wad of sheets between the clamping jaws, the lower sheets are prevented from sliding when the auxiliary stacking platform is inserted. The formation of a "bow wave" thus cannot occur.

Figure 6:
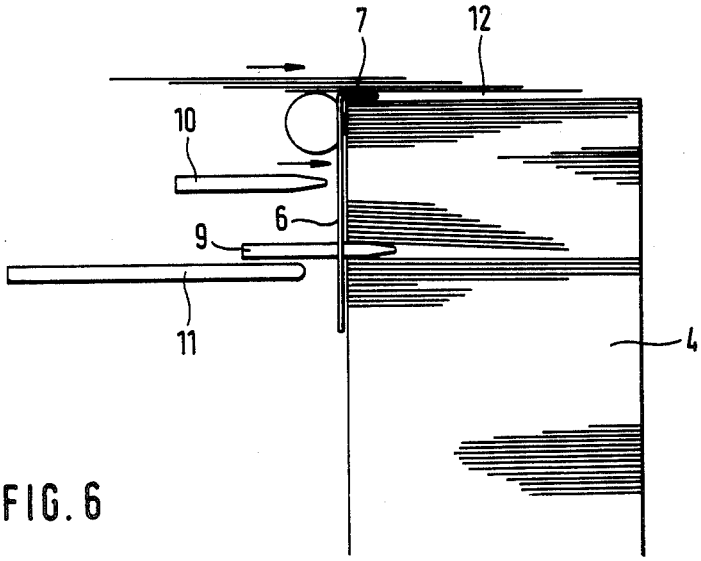
Figure 7:
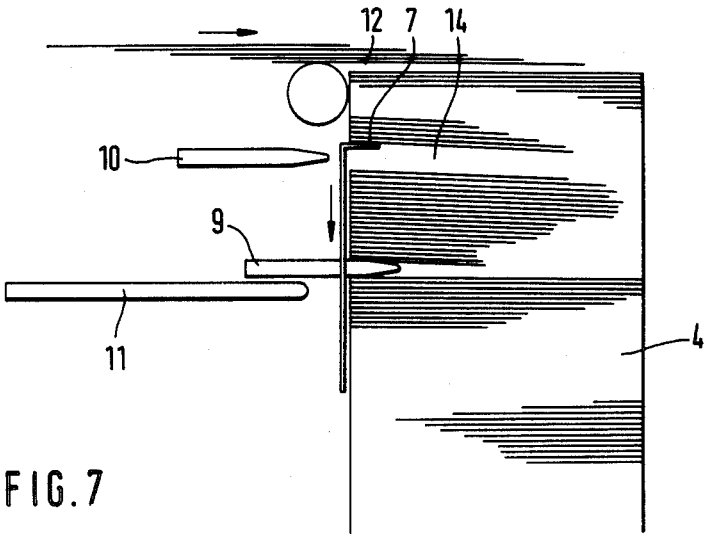
Figure 8:
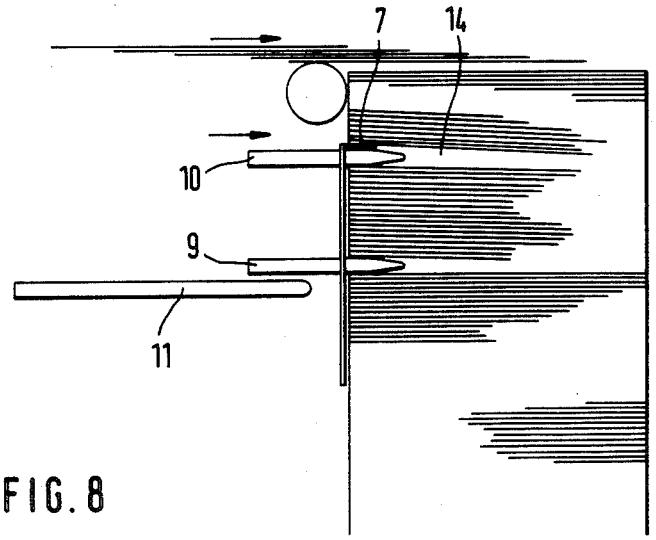
Figure 9:
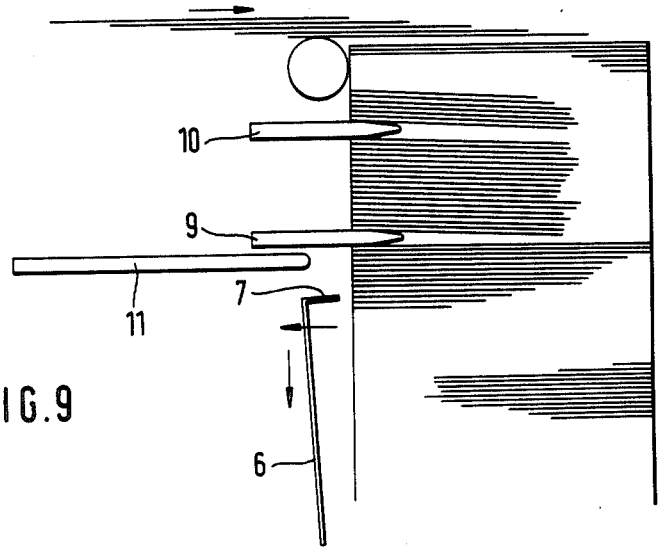
Figure 10:
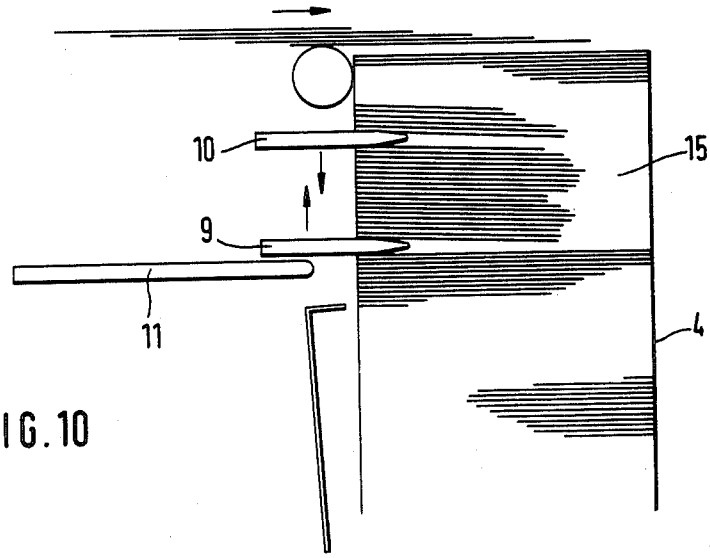
Figure 11:
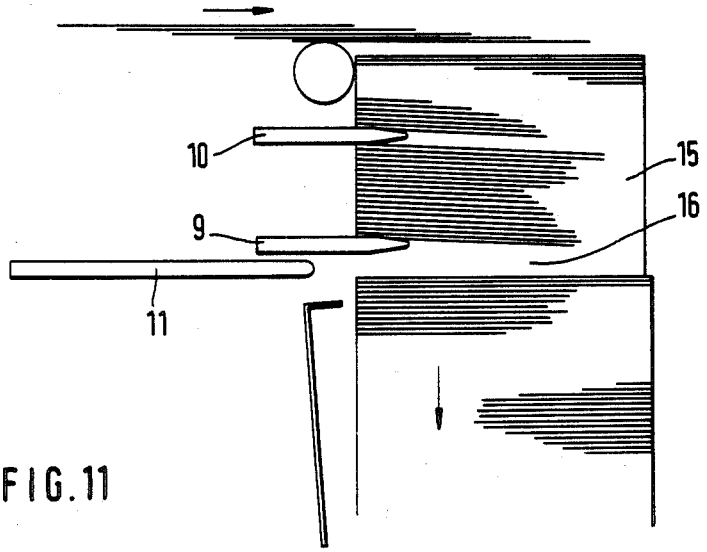
Figure 12:
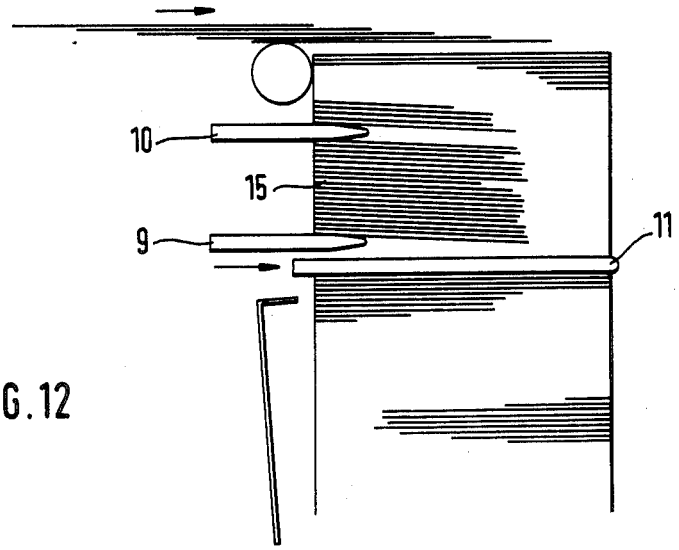
Figure 13:
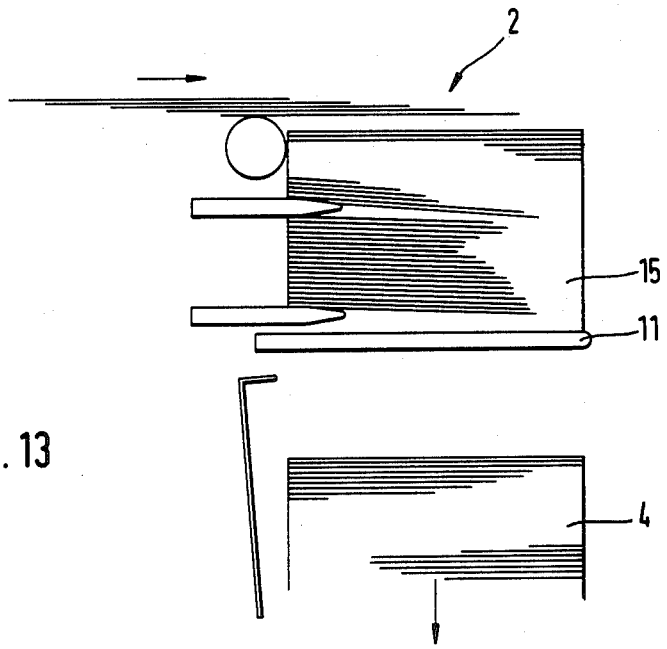
Figure 14:
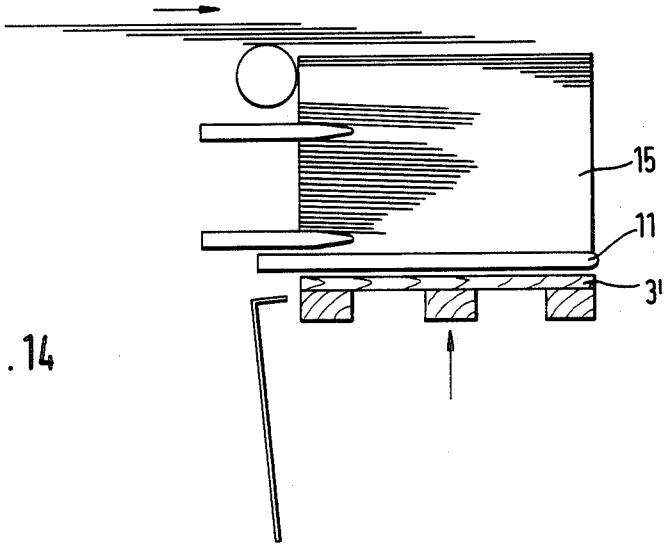
Figure 15:
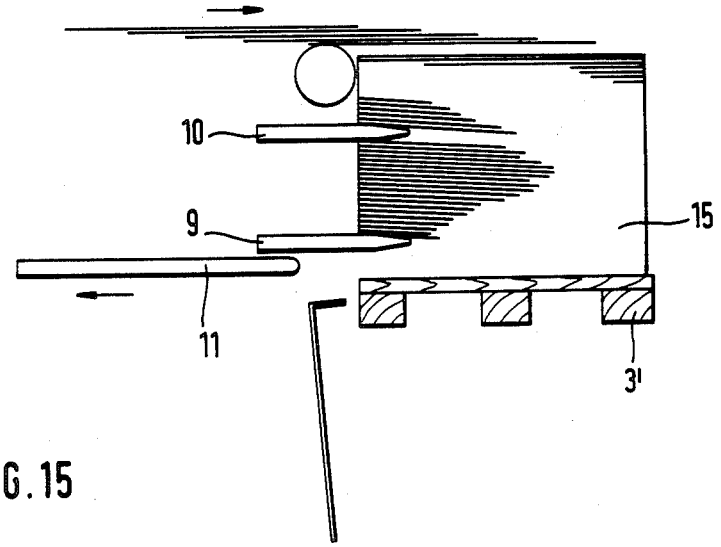
Figure 16:
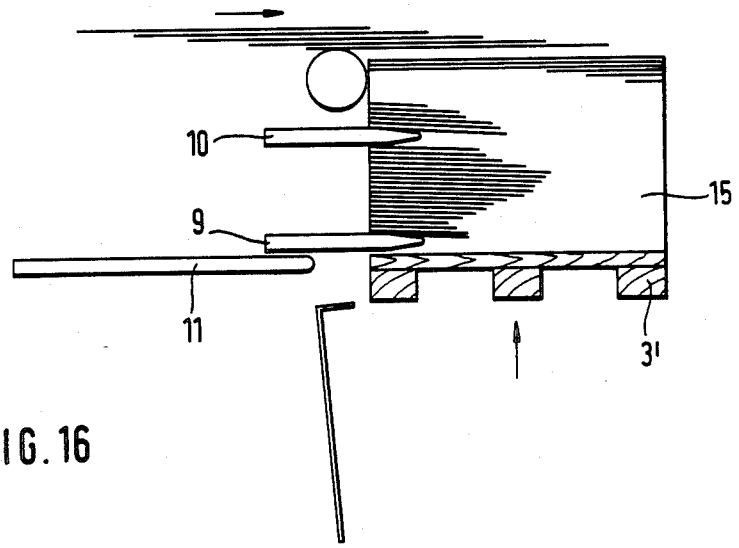
Figure 17:
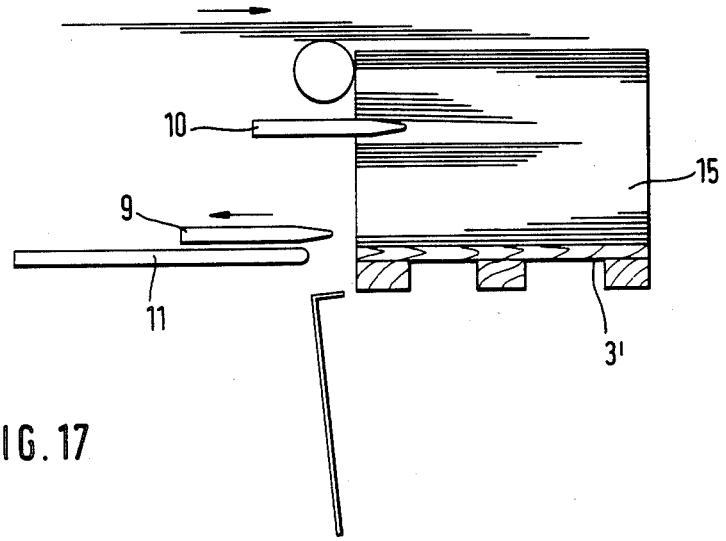
Figure 18:
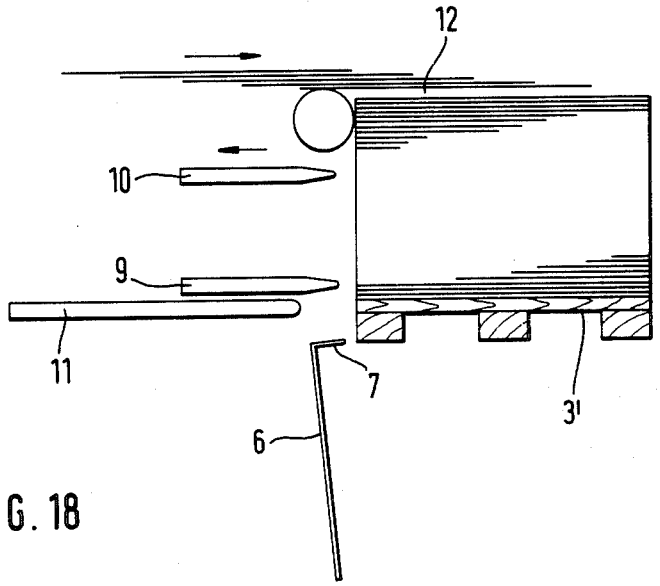
Figure 19:
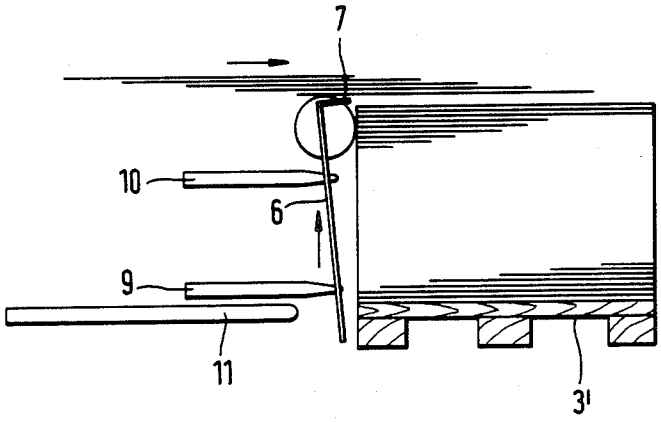

The invention is described in detail hereafter with reference to drawings wherein FIGS. 1 to 19 show different, successive stages of the change of stack, diagrammatically in side view.

Sheets 1 are conveyed in an overlapping manner to a stacking point 2 by conventional conveying means which are not shown in the drawing. A stacking platform 3 which can be lowered is located at the stacking point 2. The sheets 1 are laid in the form of a stack 4 on this stacking platform 3 which can be lowered. The conveying path of the sheets is limited by a stop (not shown) at the front side of the stack 4 in the conveying direction. Several driven ejection rollers 5 arranged at a mutual distance apart are located in the region of the stacking plane on the rear side of the stack 4 in the conveying direction.

Means for changing the stack are also provided at the rear side of the stack 4. In detail these means consist of a separating member, which comprises a swinging arm 6 and a separating plate 7 located at the free end. The separating plate 7 cannot only be tilted, but also lowered, as will be described in more detail hereafter with reference to the individual stages of the change of stack. Also provided at the rear side of the stack 4 are two clamping jaws 9, 10 of a pair of clamping jaws which can be moved forward in the conveying direction and are vertically adjustable. The separating member 6, 7 and the clamping jaws 9, 10 are constructed in the form of a fork or screen and are staggered laterally with respect to each other, so that the clamping jaws 9, 10 may engage through the separating member 6, 7. Located below the lower clamping jaw 9 in an auxiliary stacking platform 11, which may be provided on its upper side with belts guided over rollers or may be an air bar or a screen of air bars. The auxiliary stacking platform 11 is able to move in the conveying direction of the sheets and to be lowered.

Preparing for the change of the stack and carrying out the change of the stack is illustrated explicity in the drawings for the individual stages.

In stage 1, the separating plate 7 is located between the ejection rollers 5 in front of the rear side of the stack 4 and at the height of a gap 12 between the upper side of the stack 4 and the sheets 1 conveyed in an overlapping manner. The separating plate 7 is introduced into the gap 12 from this position in stage 2.

In stage 3, the stack 2 together with the separating member 6, 7 is lowered, in which case the separating member 6, 7 is lowered somewhat slower than the stack 2. Due to this the gap 12 becomes a somewhat greater gap 13. As soon as this gap 13 has reached the height of the lower clamping jaw 9, the latter is inserted into the stack 4 in stage 4. In stage 5, the separating member 6, 7 is withdrawn from the stack and brought into the initial position of stage 1. This takes place as the stack 4 is lowered further and possibly with simultaneous lowering of the lower clamping jaw 9 and the auxiliary stacking platform 11.

In stage 6, the separating member 6, 7 is inserted in the gap 12 between the upper side of the stack and the sheets 1 conveyed in an overlapping manner. As the stack 4 is lowered further, together with the separating member 6, 7 to the level of the upper clamping jaw 9, this gap 12 is increased to become the gap 14 in stage 7. In stage 8, the upper clamping jaw 10 is inserted in the stack 4, so that in stage 9 the separating member 6, 7 can be withdrawn from the stack 4 and brought into a lower waiting position.

In stage 10, the wad of sheets 15 located between the clamping jaws 9, 10 is clamped by the clamping jaws, During further lowering of the stack 4 and simultaneous lowering of the pair of clamping jaws 9, 10 with the auxiliary stacking platform 11, of course at a somewhat slower speed, the gap 13 is enlarged to become the gap 16 in stage 11, in order that the auxiliary stacking platform 11 can be inserted in stage 12.

As soon as the auxiliary stacking platform 11 is completely inserted, in stage 13 the stack of sheets 4 is lowered more quickly and removed from the region of the stacking point 2. In stage 14, an empty stacking platform 3' is raised up below the auxiliary stacking platform 11. In stage 15 the auxiliary stacking platform 11 is removed when the wad of sheets 15 is clamped and is laid on the empty stacking platform 3', in which case in stage 16 the empty stacking platform 3' can be raised somewhat.

In stages 17 to 19, the lower clamping jaw 9 and the upper clamping jaw 10 are removed from the stack in succession. In stage 19 the separating member 6, 7 is again brought into the upper preparatory position for initiating the change of a stack according to stage 1.

It will be understood that the specification and examples are illustrative but not limitative of the present invention and that other embodiments within the spirit and scope of the invention will suggest themselves to those skilled in the art.

What is claimed:

1. A method for intermittently removing stacked sheets from a continuously forming stack, comprising continuously supplying sheets to fall onto a stack formed on a platform (3) positioned therebelow forming a first gap (12) between the stack and a sheet to fall onto the stack, inserting a separating member (7) into said gap (12), whereby newly supplied sheets form an auxiliary stack above the separating member (7), lowering the stack and lowering the separating member more slowly than the stack thereby to enlarge the gap (12) to a larger gap (13), inserting a lower clamping jaw (9) into the larger gap (13), withdrawing the separating member (7) from the larger gap (13), forming a second gap (14) in the same manner as the larger gap (13), inserting an upper clamping jaw (10) into the second gap (14), clamping the sheets between the lower and upper clamping jaws (9,10), lowering the stack below the clamped jaws and lowering the clamped jaws more slowly so as to form a still larger gap (16) below the lower jaw (9), inserting a support (11) into said still larger gap (16), removing the platform (3) and sheets stacked thereon, positioning a new platform (3) below the support (11), withdrawing the support (11), raising the new platform (3') to just below the lower clamping jaw (9), removing the lower clamping jaw (9) and then the upper clamping jaw (10) whereby first the clamped sheets and then the sheets above the upper jaw (10) fall onto the new platform (3'), and repeating the cycle.

* * * * *